United States Patent [19]

Tausk

[11] Patent Number: 4,815,629

[45] Date of Patent: Mar. 28, 1989

[54] CLOSURE PLUG FOR CASTINGS

[75] Inventor: Edward F. Tausk, Downers Grove, Ill.

[73] Assignee: Navistar International Transportation Corp., Chicago, Ill.

[21] Appl. No.: 204,802

[22] Filed: Jun. 10, 1988

[51] Int. Cl.[4] ..... B65D 43/04; B65D 43/08

[52] U.S. Cl. ..... 220/352; 220/307; 220/233; 220/DIG. 19

[58] Field of Search ..... 220/307, 233, 352, DIG. 19; 217/108

[56] References Cited

U.S. PATENT DOCUMENTS

| | | | |
|---|---|---|---|
| 1,058,210 | 4/1913 | Welch . | |
| 1,801,006 | 4/1931 | Jacoby . | |
| 2,330,742 | 9/1943 | Poupitch . | |
| 2,491,213 | 12/1949 | Robinson, Jr. . | |
| 2,541,250 | 2/1951 | Hogg . | |
| 2,789,721 | 4/1957 | Schoessow . | |
| 3,028,036 | 4/1962 | Goll . | |
| 3,123,245 | 3/1964 | Dumpis | 220/233 |
| 3,146,748 | 9/1964 | Knocke | 220/233 |
| 3,200,984 | 8/1965 | Fueslein et al. . | |
| 3,269,582 | 8/1966 | Knocke . | |
| 3,448,772 | 6/1969 | Delamater . | |
| 3,451,583 | 6/1969 | Lee, II | 220/233 |
| 3,578,027 | 5/1971 | Zoffi . | |
| 4,202,463 | 5/1980 | Mogler | 220/307 |
| 4,287,996 | 9/1981 | Wanderer | 217/108 |
| 4,736,865 | 4/1988 | Rericha | 220/307 |

*Primary Examiner*—George T. Hall

*Attorney, Agent, or Firm*—F. David Aubuchon; Dennis K. Sullivan

[57] ABSTRACT

A two-element plug having an elastomeric body and a nonsealing retainer molded within the elastomeric body, the retainer having gripping edges which springingly engage portions of the hole walls to maintain the plug body in place, even against a rough as-cast surface having a draft angle. Discontinuities are formed in the gripping edge periphery through the use of scallops and the gripping edge periphery extends beyond the elastomeric periphery to promote better engagement of the walls of the aperture. When used with noncircular holes having rounded corner portions, the retainer is truncated in the corner portions.

15 Claims, 1 Drawing Sheet

10
12
13
14
15
16
18
19
20
22
24
32

CLOSURE PLUG FOR CASTINGS

This invention relates to plugs for sealing corded holes or apertures in castings and, more particularly, to a closure plug having a spring retainer molded within the plug to engage the as-cast wall of the casting aperture to maintain the plug in position while the elastomeric portion of the plug seals the aperture.

BACKGROUND OF THE INVENTION AND THE PRIOR ART

In the course of making castings, for example, the crankcase of an internal combustion engine, it is often necessary to have cored holes in the finished casting as a result of the need to support internal cores, for example, for the cores performing the coolant passages, during the casting process. These cored holes generally are required to be sealed, especially if they are in the side of the crankcase but often even when located in the top deck of the crankcase which interfaces with the cylinder head gasket and cylinder head.

A conventional method of sealing cored holes is to first machine a counterbore and then press a metal cup plug which is retained against the machined side walls of the castings by an interference fit. Another method is to insert a Welch or expansion plug, a concave disk, in the machined bore and flatten out the disk as shown in Welch U.S. Pat. No. 1,058,210. However, each of these methods requires a machined counterbore since these metal plugs will not seal an as-cast surface. Additionally, as a practical matter, the holes have to be circular and an as cast hole may not be circular especially if the mold parting line passes along a diameter of the hole.

It is also known to seal holes of various types with elastomeric plugs, for example, those shown in U.S. Pat. Nos. 3,200,984, 3,578,027, 4,287,996, and 4,736,865. However, such plugs generally held in place by the compression of the elastomeric material against the side walls and are more susceptible to being blown out by internal pressure, for example, the coolant pressure in the crankcase, especially if installed in a tapered hole as might result from the draft angle of an as-cast hole.

SUMMARY OF THE INVENTION

The present invention provides a two-element plug having an elastomeric body and a nonsealing retainer molded within the elastomeric body, the retainer having gripping edges which springingly engage portions of the hole walls to maintain the plug body in place, even against a rough as-cast surface having a draft angle. Discontinuities are formed in the gripping edge periphery through the use of scallops and the gripping edge periphery extends beyond the elastomeric periphery to promote better engagement of the walls of the aperture. When used with noncircular holes having rounded corner portions, the retainer is truncated in the corner portions.

Applicant's invention provides separation of the sealing and retaining functions of the plug. Among the advantages of separating these functions is that the elastomer can be softer and more compliant to the rough sealing surface of the castings to enhance sealing without increasing the risk of the plug escaping from the hole because of reduced plug rigidity. A second advantage is that the retainer gripping edges do not have to be continuous because the retainer does not seal and therefore may have corners and bent portions (as a result of installation) which will provide better engagement of the retainer with the rough side walls of the casting. Discontinuous gripping edges further provide the advantage that in sealing noncircular holes, especially those having rounded corners or those having slightly offset halves due to mold movement, the gripping edges can be locally absent to provide for better sealing by the elastomeric portions in these critical areas while the plug as a whole is less sensitive to small variations in hole size and shape. Such absence of the gripping edges in corners, as well as the scallops in the straight portions of the retainer periphery, will also reduce the potential for separation of the elastomeric portions from the metal portions by providing a continuous elastomeric section in these areas.

Yet a further advantage of the invention is that the plate like retainer will be bent in the course of installation to produce a convex shape in the direction of the interior side of the aperture into which the plug is inserted. Thus, as the pressure increases within the casting, the pressure to flatten the convex surface of the plug will increase the loading on the gripping edges further locking the plug within the aperture.

DETAILED DESCRIPTION OF THE DRAWINGS

Other objects and advantages of the invention will become more apparent upon reading the detailed description thereof and upon perusal of the drawings in which.

DETAILED DESCRIPTION OF THE INVENTION

Figures 1, 2, 3, 4:
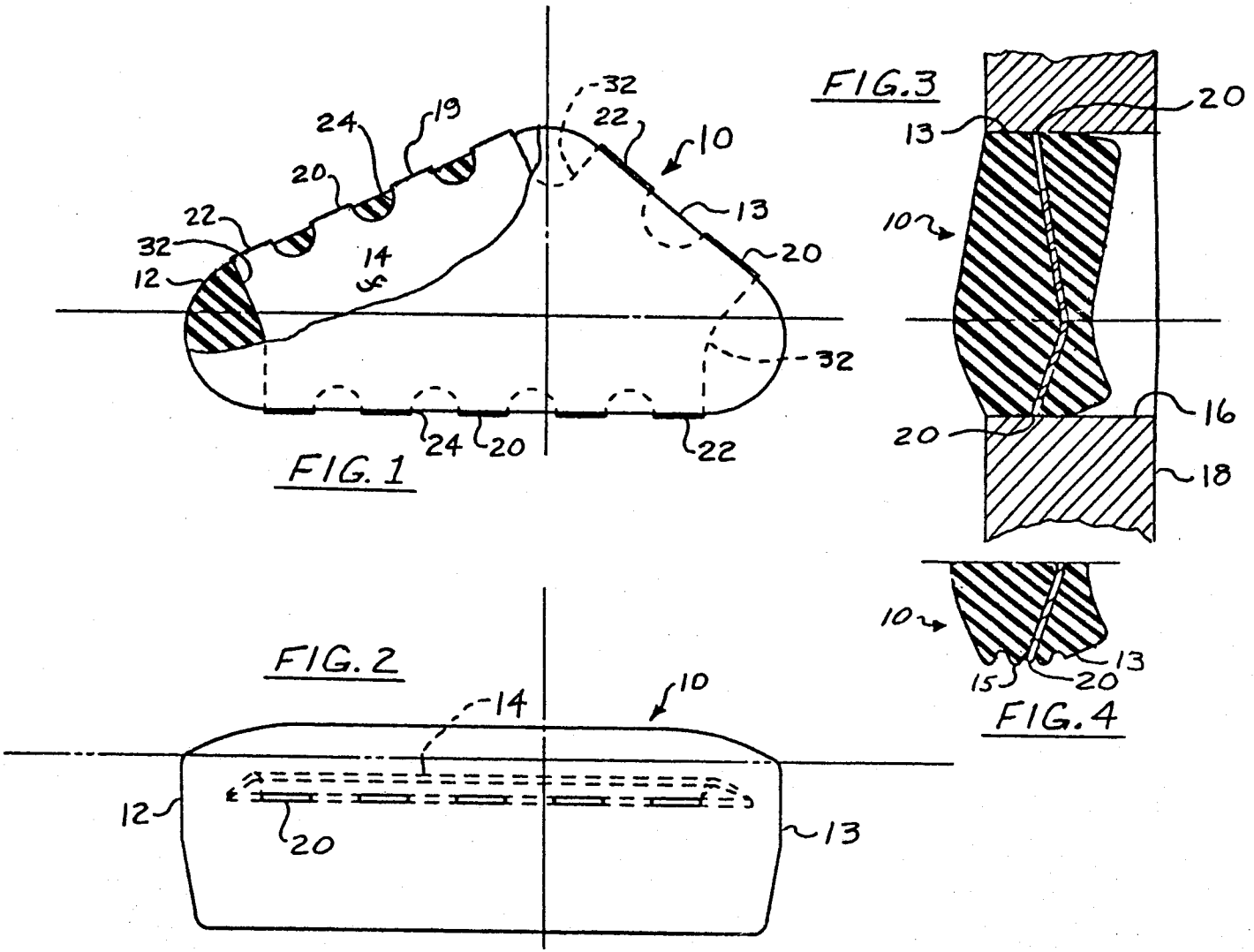
FIG. 1 is a plan view, partially cut away, of a closure plug constructed in accordance with the invention prior to installation in a casting aperture.
FIG. 2 is an elevation view of the closure plug of FIG. 1 in the free state.
FIG. 3 is a sectional elevation of the closure plug taken along the line 3—3 of FIG. 1 but illustrating the closure plug installed in a casting aperture.
FIG. 4 is a sectional elevation similar to a portion of FIG. 3 but illustrating an alternative embodiment of the closure plug.

Referring to FIG. 1, there is shown a closure plug 10 which comprises an elastomeric portion 12 and a spring retainer 14 molded therewithin. The closure plug 10 is designed for insertion into an as-cast cored hole or aperture 16 in a casting 18, such as the top deck of an engine crankcase, as shown in FIG. 3. The elastomeric portion 12 of the closure plug 10 is preferably made of an elastomer, such as nitrile rubber or epichlorohydrin, having high swell characteristics and has a smooth periphery 13 approximately conforming to the periphery of the aperture 16 so as to seal the aperture when installed. Optionally, as shown in FIG. 4, the periphery 13 of plug 10 may have peripherally extending ribs 15 disposed on its sealing surface to provide increased sealing pressure by reducing the area of the sealing surface.

The retainer 14 preferably is made of spring steel but it could also be made of certain plastics or composites, such as polycarbonates or graphite-glass fiber composites, having nonyielding spring-like characteristics similar to spring steel. When the plug 10 is in its free state, the retainer 14 is a nearly flat sheet, as shown in FIG. 2, having a periphery 19 defined by the gripping edges 20 of a plurality of gripping fingers 22 alternating along the retainer periphery 19 with scalloped portions 24. To ease the insertion of the plug into the aperture 16, the retainer 14 may be bent to a slightly convex shape even in the free state. The periphery 19 of the retainer 14 is sized relative to the casting aperture 16 so that the fingers 22 and gripping edges 20 extend beyond the periphery of the aperture 16 in the free state of the plug 10. The gripping edges also extend beyond the periphery 13 of the elastomeric portion 12 to improve their engagement with the wall of aperture 16.

When the plug 10 is inserted from the exterior of the casting into the aperture 16, as in FIG. 3, the nearly flat retainer 14 will be bent, along with the elastomeric portion 12, to a convex shape facing inwardly in the aperture 16 as the gripping edges 20 engage the wall of aperture 16. The benefits of having the convex shape in the inserted position, as shown in FIG. 3, can easily be seen if one visualizes increasing the coolant pressure on the inside of the casting (the right side in FIG. 3). Increased coolant pressure will attempt to flatten the retainer 14 thus putting additional retaining load on the gripping edges 20 against the walls of the aperture 16. Additionally, by being nearly the same size as the elastomeric portion 12, the retainer 14 also functions as a reinforcement of the elastomeric portion.

An especially useful feature of the invention when sealing noncircular apertures is the truncation of the corner portions of the retainer as at 32. Because of this truncation, the rigid retainer 14 does not require close tolerances to fit the corners of the aperture. Additionally, the elastomeric portion 12 can more easily conform to the corner as well as tolerate the variations therein without being restrained by the retainer and the possibility of the elastomer separating from the retainer is reduced by the monolithic section of the elastomeric portion in the corners.

Thus, there has been described in accordance with the invention, a closure plug that fully meets the objects and advantages set forth above.

What is claimed is:

1. A closure plug adapted for plugging a casting aperture having as-cast side walls comprising:

a sealing plug body comprising high swell elastomeric material, said plug body having a periphery substantially sealingly corresponding to the periphery of said as-cast aperture; and a nonsealing spring steel retainer means disposed within said plug body, said retainer means having peripheral gripping edges disposed to springingly engage portions of the peripheral wall of said aperture, said peripheral gripping edges defining a periphery larger than said aperture.

2. The invention in accordance with claim 1 and said gripping edges having peripheral discontinuities therein such that said retainer means is disposed to engage less than the entire periphery of said aperture.

3. The invention in accordance with claim 2 wherein said gripping edge periphery includes scallopped cutout portion.

4. The invention in accordance with claim 1 and said nonsealing spring steel retainer means comprising a thin sheet molded within said plug body and spanning a sufficient area of said plug body to function as a reinforcement of said body.

5. The invention in accordance with claim 1 and said plug periphery having rounded corner portions, said retainer means being truncated to be absent from said corner portions.

6. The invention in accordance with claim 1 in said gripping edges extending beyond said elastomeric portions n the free state of said closure plug.

7. In combination with a casting having an aperture having as-cast side wall portions, a closure plug for sealing said aperture comprising:

an elastomeric plug body having a periphery substantially sealingly conforming to the periphery of said aperture;

a nonsealing spring retainer molded within said plug body and having peripheral gripping edges disposed in springingly engaged relation against said aperture side walls.

8. The invention in accordance with claim 7 and said retainer comprising a spring steel sheet having gripping edges disposed on its periphery.

9. The invention in accordance with claim 8 and said gripping edges defining, in the free state, a periphery extending beyond the side walls of said aperture.

10. The invention in accordance with claim 8 and said gripping edges extending beyond the periphery of said plug body in the free state.

11. The invention in accordance with claim 7 and said casting aperture and said pug body having mating rounded corner portions, said retainer comprising a sheet member truncated across said corner portions.

12. The invention in accordance with claim 7 and said retainer comprising a sheet member having peripheral scallops cutouts defining said gripping edges therebetween.

13. The invention in accordance with claim 7 in said casting aperture being noncircular.

14. The invention in accordance with claim 7 wherein said casting aperture wall tapers smaller inwardly of said casting at a draft angle formed in casting.

15. The invention in accordance with claim 7 and said retainer having a convex shape facing inwardly of said casting.

* * * * *